US005914849A

United States Patent [19]

Perreira

[11] Patent Number: 5,914,849

[45] Date of Patent: Jun. 22, 1999

[54] DC ACTUATOR CONTROL CIRCUIT WITH VOLTAGE COMPENSATION, CURRENT CONTROL AND FAST DROPOUT PERIOD

[75] Inventor: G. Stephen Perreira, Carpinteria, Calif.

[73] Assignee: Kilovac Corporation, Carpenteria, Calif.

[21] Appl. No.: 08/643,469

[22] Filed: May 6, 1996

Related U.S. Application Data

[63] Continuation-in-part of application No. 08/233,629, Apr. 26, 1994, abandoned.

[51] Int. Cl.[6] ..... H01H 47/02

[52] U.S. Cl. ..... 361/187; 361/154; 361/160

[58] Field of Search ..... 361/152, 153, 361/154, 159, 160, 187

[56] References Cited

U.S. PATENT DOCUMENTS

| | | | |
|---|---|---|---|
| 4,205,361 | 5/1980 | Shimp | 361/154 |
| 4,339,781 | 7/1982 | Harsch et al. | 361/154 |
| 4,399,483 | 8/1983 | Phelan | 361/154 |
| 4,511,945 | 4/1985 | Nielsen | 361/154 |
| 4,605,983 | 8/1986 | Harvey | 361/154 |
| 4,630,015 | 12/1986 | Gernhardt et al. | 335/18 |
| 4,661,766 | 4/1987 | Hoffman et al. | 323/287 |
| 4,835,655 | 5/1989 | Ricci et al. | 361/159 |
| 4,890,188 | 12/1989 | Russell et al. | 361/154 |
| 4,907,121 | 3/1990 | Hrassky | 361/154 |
| 4,947,283 | 8/1990 | Kono | 361/154 |
| 4,949,215 | 8/1990 | Studtmann et al. | 361/154 |
| 5,055,961 | 10/1991 | Wiblin et al. | 361/154 |
| 5,113,307 | 5/1992 | Meyer et al. | 361/154 |
| 5,255,152 | 10/1993 | Estes, III et al. | 361/160 |
| 5,343,351 | 8/1994 | Quantz | 361/33 |
| 5,471,360 | 11/1995 | Ishikawa et al. | 361/154 |
| 5,508,906 | 4/1996 | Nelli et al. | 361/154 |
| 5,541,806 | 7/1996 | Hoffman | 361/154 |
| 5,557,494 | 9/1996 | Ishikawa et al. | 361/152 |

OTHER PUBLICATIONS

The encyclopedia of electronic circuits, Rudolf Graf, Tab Books, p. 464, Monostable Circuit, 1985.

*Primary Examiner*—Fritz Fleming
*Attorney, Agent, or Firm*—Christie, Parker & Hale,LLP

[57] ABSTRACT

The DC actuator control circuit with voltage compensation, current control and fast dropout period employs an electronic chopper incorporating an oscillator having a variable duty cycle controlled by sensing of coil current. Coil current is sampled through a series resistor by a feedback amplifier which increases or decreases the period in which the switch for the coil circuit remains on to sustain average coil current at the desired MMF. A threshold detector provides an initial triggering signal to initiate operation of the actuator and the control circuit responsive to a predetermined source voltage and a gate signal generator responds to the triggering signal with a time constant sufficient to drive the coil through a pickup interval. Inrush current is limited by the oscillator through sensing of coil current. A dropout switch for opening the sustaining current return circuit which opens upon removal of source voltage provides a high impedance for rapid current drain from the coil thereby eliminating regeneration effects.

10 Claims, 10 Drawing Sheets

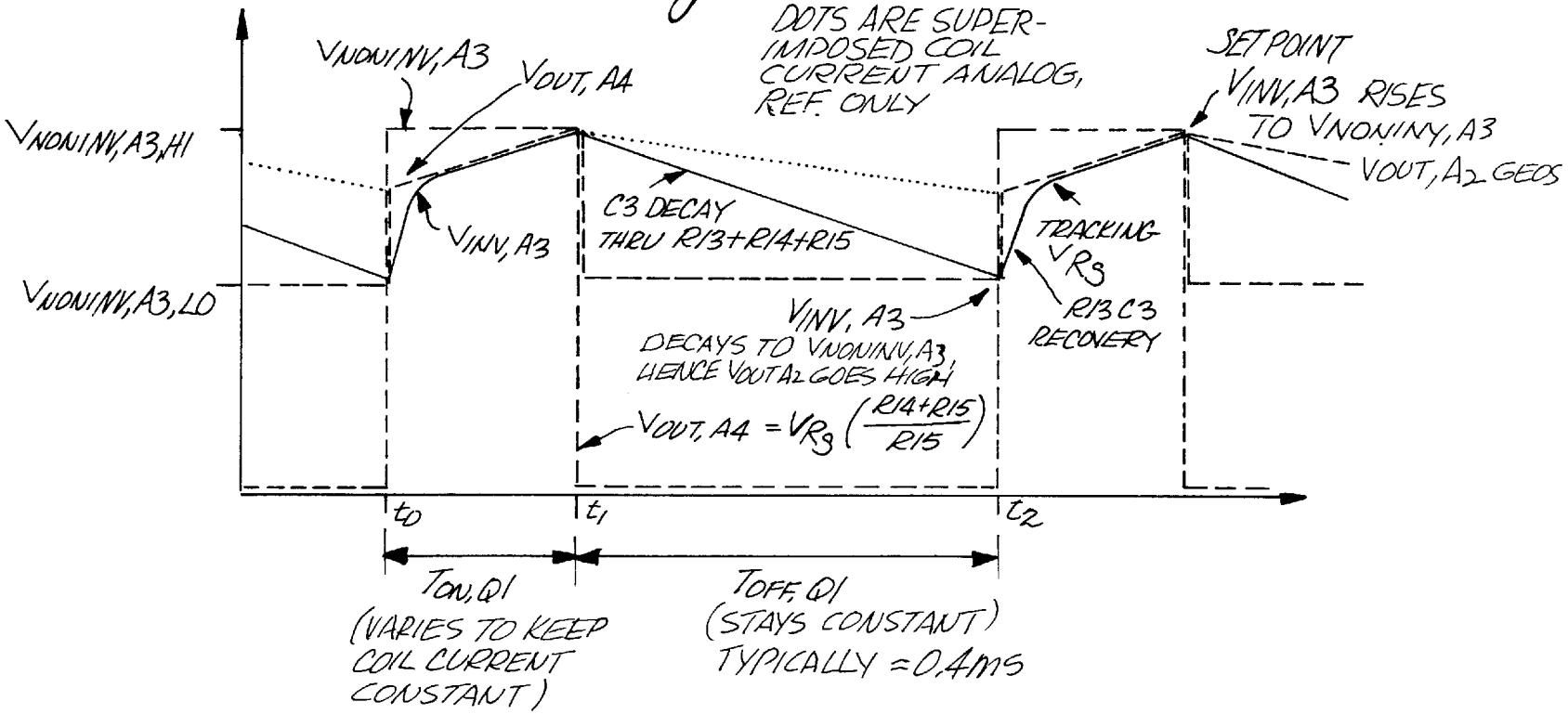
Fig. 5
DOTS ARE SUPER-IMPOSED COIL CURRENT ANALOG, REF. ONLY
SET POINT $V_{INV,A3}$ RISES TO $V_{NOUINV,A3}$
$V_{OUT,A2}$ GEOS
TRACKING $V_{R3}$
R13 C3 RECOVERY
$V_{INV,A3}$
DECAYS TO $V_{NOUINV,A3}$, HENCE $V_{OUT,A2}$ GOES HIGH
$V_{OUT,A4} = V_{R3}\left(\frac{R14+R15}{R15}\right)$
C3 DECAY THRU R13+R14+R15
$V_{OUT,A4}$
$V_{INV,A3}$
$V_{NOUINV,A3}$
$V_{NOUINV,A3,HI}$
$V_{NOUINV,A3,LO}$
$t_0$
$t_1$
$t_2$
$T_{ON,Q1}$ (VARIES TO KEEP COIL CURRENT CONSTANT)
$T_{OFF,Q1}$ (STAYS CONSTANT) TYPICALLY ≈ 0.4ms

DC ACTUATOR CONTROL CIRCUIT WITH VOLTAGE COMPENSATION, CURRENT CONTROL AND FAST DROPOUT PERIOD

RELATED APPLICATION INFORMATION

The present application is a continuation-in-part of Ser. No. 08/233,629 filed Apr. 26, 1994, now abandoned, the disclosure of which is incorporated herein by reference.

BACKGROUND OF THE INVENTION

A. Field of the Invention

The present invention is directed generally to the field of economizers for spring-biased DC actuators. In particular, the present invention provides a control circuit for power reduction using an electronic chopper incorporating an oscillator having a variable duty cycle responsive to the source voltage to maintain average coil holding current at a level to assure minimum required magnetomotive force (MMF), defined as units of coil turns multiplied by coil amperes, for the actuator coil and including current sensing to provide inrush current limitation lower energy operation. Additionally, the invention includes an electronic dropout switch providing high impedance for rapid current decay upon deactivation of the actuator.

B. Prior Art

Spring-biased DC actuators are employed for numerous applications including high power contactors requiring fail-safe capability. Such actuators typically require significant MMF to overcome armature and contactor inertia and spring force for closing the contactor. However, once closed, the contactor may be retained in a closed position at significantly lower MMF. Various prior art methods have been applied to provide initial high currents to the actuator coil to obtain contact closure with subsequent reduction of the current to maintain MMF at a level required to resist the spring force and maintain the contact in the closed position.

To assure minimum MMF in conditions of high temperature, wherein coil resistance may be significantly altered, and power changes due to voltage sagging in the power supply, most designs require a significant safety factor to be applied to the current level maintained in the coil, precluding optimizing of performance. Prior art systems employing chopper circuits to reduce average current in the coil must provide sufficient MMF to accommodate worst-case conditions. Higher currents which need to be maintained exacerbate the situation by contributing to heating of the coil.

In addition, the use of most prior art choppers as an economizer circuit results in difficulties during de-actuation of the circuit. Addition of a chopper controller normally increases dropout time due to slow decay of coil current through the low-impedance return circuit employed in chopper economizers. Regeneration in the coil created by motion of the armature while current is still flowing in the coil impacts the velocity and kinetic energy of the armature, thereby extending the dropout time and weakening the action that breaks open sticky contacts. The present invention overcomes the difficulties in the prior art to allow high efficiency in conservation of coil power, enhancement of mechanical performance, and potential reduction in size of actuators for given applications.

SUMMARY OF THE INVENTION

The present invention provides an improved economizer for DC actuator coil current control in spring-biased DC actuators. The actuator coil circuit receiving power from a voltage source is controlled by a chopper circuit which incorporates a switch in the coil circuit which is closed responsive to a control signal generated by a power-switching circuit. The power-switching circuit incorporates a threshold detector which provides a triggering signal to initiate operation of the actuator and the control circuit responsive to a predetermined source voltage, a gate signal generator responsive to the triggering signal and having a time constant sufficient to drive the coil through a pickup interval, and a variable duty cycle oscillator for generating the switch control signal. The oscillator passes the gate signal during the pickup interval, provides current inrush limitation and subsequently varies its duty cycle responsive to the voltage of the voltage source by sampling coil current.

Modification of duty cycle for the oscillator is accomplished under current control, operated in response to the power source for the coil. The change in the duty cycle increases or decreases the period in which the switch for control of the coil circuit remains on, providing energy pulses to sustain average coil current at the desired MMF. Sensing of coil current is accomplished by sampling the coil current through a series resistor only while the coil circuit is on. The sensed signal is amplified, conditioned and fed back into the oscillator for adjustment of the duty cycle. Because the sensed and regulated coil parameter is coil current, the negative effects of coil source voltage change and coil resistance change, due to temperature effects of self heating and changeing environmental conditions, are fully compensated. An actuator employing the present invention is, therefore, operating in the lowest possible coil power state, where $$\text{COIL POWER} = (I_{COIL})^2 R_{COIL}$$

$$\text{COIL POWER} = \frac{(N_{COIL} \times I_{COIL})^2 R_{COIL}}{N_{COIL}^2}$$

$N_{COIL}$=Coil Turns=Constant $I_{COIL}$=Coil DC Avg. Current.

$R_{COIL}$=Coil Resistance $$\text{COILPOWER} = \frac{(MMF)^2 R_{COIL}}{N_{COIL}^2}$$

$$\text{MMF}=N_{COIL} I_{COIL}$$

Coil power is proportional to the MMF in a square law relation.

The present invention also incorporates a dropout switch for opening the sustaining current return circuit for the coil, which operates in concert with the power switching circuit to maintain coil current. The dropout switch is opened by removal of source voltage, producing a high impedance for rapid current drain from the coil, thereby eliminating the regeneration effect typically present in chopper economizer circuits.

BRIEF DESCRIPTION OF THE DRAWINGS

The present invention will be more clearly understood in reference to the following drawings and detailed description.

FIG. 5 is a timing diagram showing the waveforms for the current sampling and control circuit;

DETAILED DESCRIPTION

Figure 1:
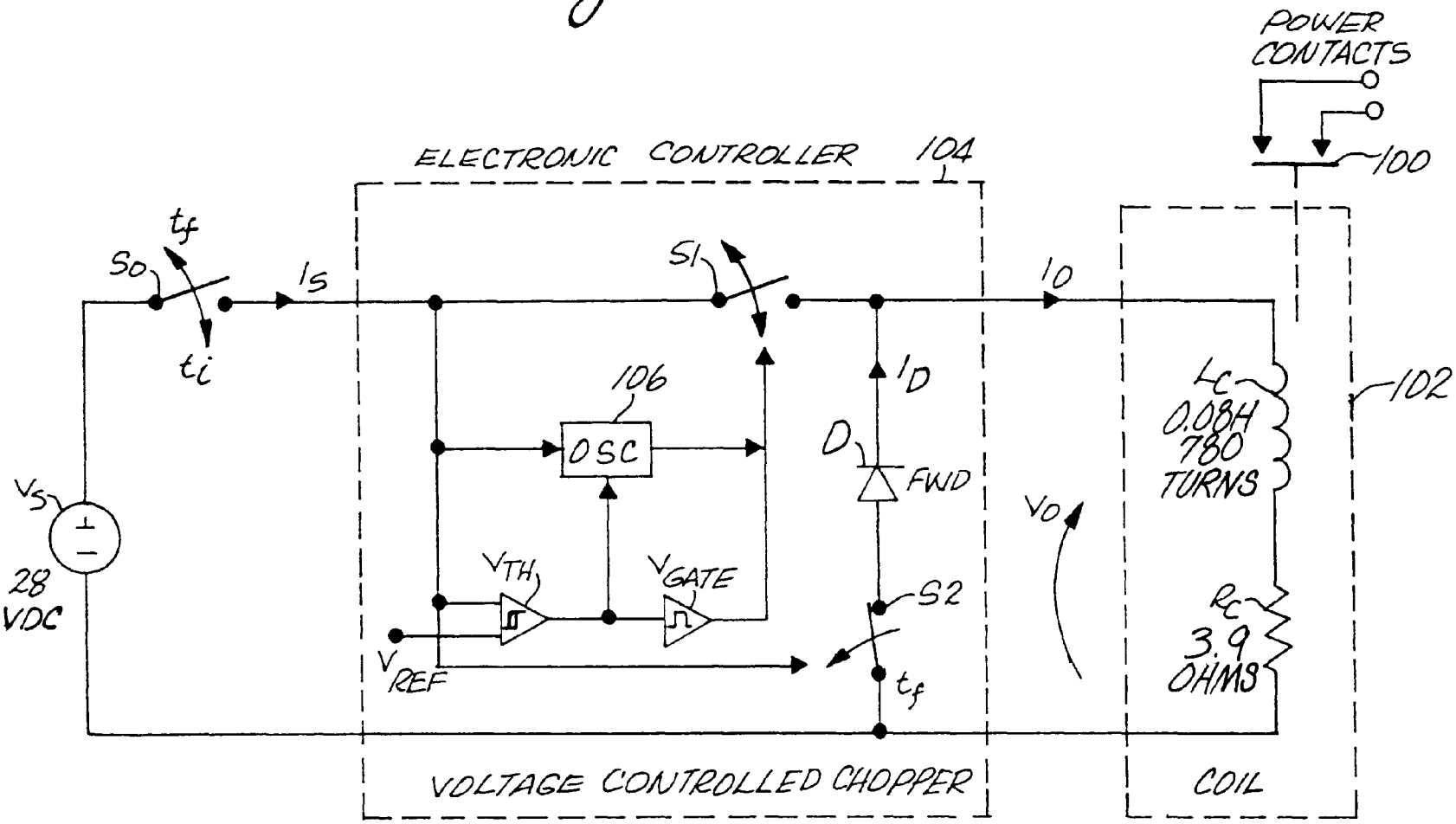
FIG. 1 is a block diagram of the invention employing a current-controlled oscillator.

Referring to the drawings, FIG. 1 shows a conceptual operation of the invention in block diagram form. As exemplary of the application of the invention, a high-power contactor 100 constitutes the application in which the invention is used. High-power contactors require rapid armature acceleration for proper contact closure and rapid drop-out of the contactor to preclude arcing and to break open welded contacts. Significant armature power is required to minimize contact bounce during contact closure and, therefore, minimize weld strength caused by arcing during contact bounce during closure under electric load, and again preclude contactor damage by arcing. In FIG. 1, the contactor 100 is driven by coil 102 which is schematically represented by inductor $L_c$ representing a 780-turn coil having an inductance of approximately 0.08 H and a resistance $R_c$ of 3.9 ohms. Power is supplied by a voltage source $V_s$ which, in the applications shown, comprises a 12 VDC source, and opening and closing the contactor is accomplished by switch $S_0$. The present invention is embodied in the electronic controller 104 which comprises a chopper for reducing power from the voltage source to the coil. A switch $S_1$ opens the coil circuit, and sustaining current for the coil flows through a sustaining circuit incorporating diode D and switch $S_2$.

Switch $S_1$ is controlled by an oscillator 106, a threshold voltage amplifier $V_{TH}$ and a gate amplifier $V_{gate}$. The threshold voltage amplifier or threshold voltage detector determines if the source $V_s$ provides sufficient potential for pick-up to occur in the coil. Once the voltage threshold has been exceeded, the gate amplifier provides a gate signal which closes switch $S_1$ allowing the coil to receive full source voltage during the pick-up interval. After pick-up, the oscillator 106 begins chopping the source current by periodically opening switch $S_1$, allowing the holding current to decay to a steady state level based on sensed coil current signal at resistor $R_s$. The oscillator is current-controlled to compensate for source voltage variations and temperature change effect on the coil resistance. As an example, the on time for the oscillator is increased when voltage sag occurs in the power supply, thus maintaining essentially constant average current in the coil. A drop-out switch $S_2$ is provided in the current return to accommodate a second feature of the invention, rapid drop-out. Switch $S_2$ is maintained in the closed position by the source voltage and, when source voltage is removed by opening of switch $S_0$, switch $S_2$ opens which substantially increases the impedance in the coil circuit allowing rapid coil current decay.

Figure 2:
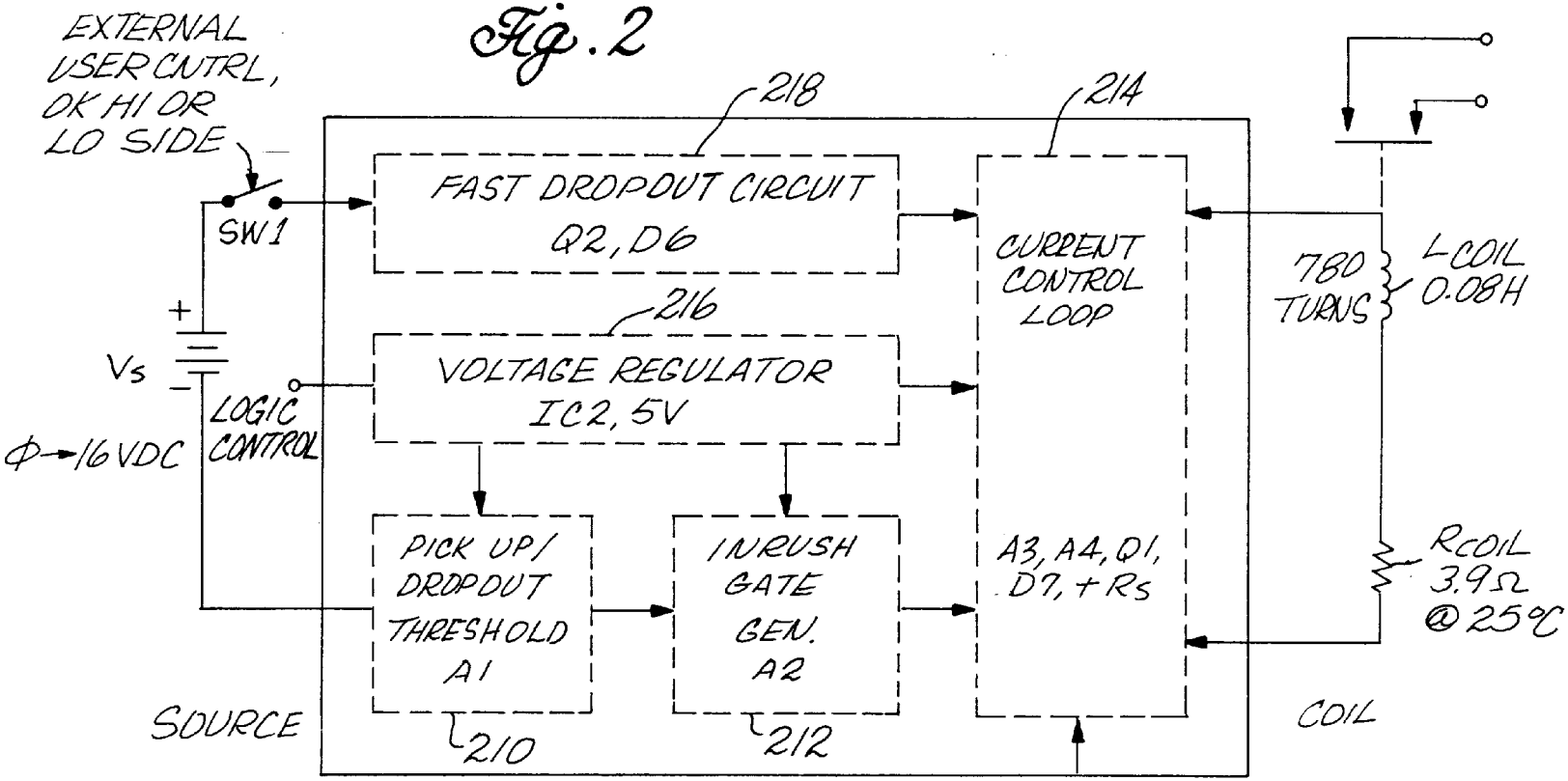
FIG. 2 is a block diagram of the elements for an embodiment of the invention providing the functions of FIG. 1 and incorporating a current sensing and control loop.

FIG. 2 shows the major elements of a first embodiment of the invention incorporating the functions described with respect to FIG. 1. Upon actuation of the coil control circuit through switch $S_0$, or other means as will be described subsequently, the pickup/dropout threshold circuit 210 senses source voltage and upon reaching a pickup threshold energizes the relay coil through the control circuit. Inrush gate generator 212 provides a timed gate interval during which full power from the voltage source is provided for pickup of the armature and provides a reference voltage for inrush current control as will be described in greater detail subsequently.

The current control loop 214 is activated by the inrush gate generator and incorporates a variable duty cycle oscillator and the switch for coil current control with a free wheeling diode to sustain coil current during switching. The current control loop also provides a rectifier amplifier sampling current in the coil for feedback control of the duty cycle of the oscillator. A voltage regulator 216 provides a voltage source for the operational amplifiers in the circuit and a voltage reference for the control functions. Additionally, the voltage regulator provides the capability for logic control switching of the circuit providing on/off control by logic level signal to the voltage regulator supplementing or replacing switch $S_0$.

The fast dropout circuit 218 shunts current from the coil to a Zener diode, upon removal of source voltage, to absorb coil energy quickly and prevent regeneration in the coil which would inhibit rapid armature motion for breaking and opening the armature contacts.

Figure 3:
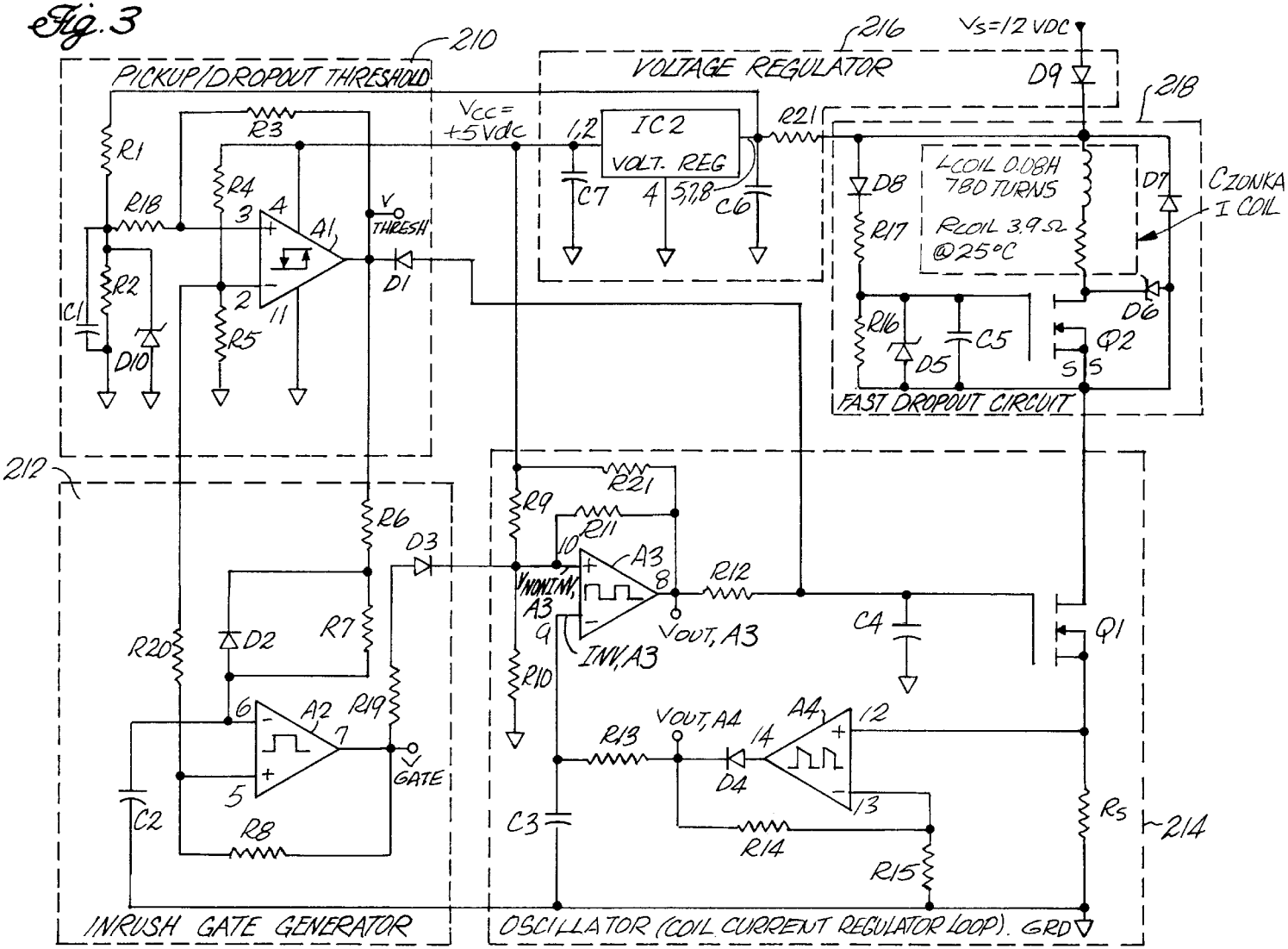
FIG. 3 is an electrical circuit schematic of the embodiment shown in FIG. 2.

FIG. 3 shows a detailed circuit for implementing the elements of the invention shown in FIG. 2. The embodiment shown in the detailed schematic is designed for use in an automotive application employing standard 12 VDC power. Such applications often incur source voltage variations between 6.5 and 24 VDC, necessitating a control system such as that disclosed for the present invention. The pickup/dropout threshold circuit employs amplifier A1 as a threshold detector for determining the source voltage levels to trigger pickup (energization of the relay coil and closure of the power contacts) and dropout (deenergization of the relay coil and opening of the relay contacts). The threshold detector ensures that adequate voltage amplitude is available to ensure pickup and to cut off coil source power if the source voltage dips too low to safely hold the contacts closed. Amplifier A1 acts as a voltage comparator providing pickup between 8 and 9 VDC and dropout between 6.5 and 5 VDC for the nominal 12 VDC coil power system.

Resistors R4 and R5 form a voltage divider between the regulated 5 volt reference, to be described in greater detail subsequently, for the comparator at the inverting input of amplifier A1. The coil voltage source $V_s$ is connected to amplifier A1 through the network divider R1 and R2 via diode D9 and resistor R21. Resistors R18 and R3 form a feedback path from the output of amplifier A1 to the non-inverting input to distinguish the pickup threshold from the dropout threshold for the circuit. Capacitor C1 is a noise filter and zener diode D10 clamps source transients protecting the non-inverting input of amplifier A1.

Operation of the pickup/dropout threshold circuit is best described with respect to a ramped source voltage input which represents a worst case start up condition. When source voltage $V_s$ is ramped up from zero the output of amplifier A1 is low (near ground potential). The value of resistors R1, R2, R3 and R18 is selected to provide a rise in the non-inverting input of amplifier A1 to the value of the inverting input when the source voltage is nominally 8.5 VDC. At that level, the voltage source can deliver sufficient current to the coil to ensure pickup and output of amplifier A1 abruptly shifts high. A high output on amplifier A1 is provided through the gate generator for switching on coil current as will be described in greater detail subsequently.

A high output on amplifier A1 provides regenerative feedback through resistor R3 raising the voltage at the non-inverting input to provide hysteresis for the voltage level for dropout. When source voltage is reduced to nominally 5.8 volts DC the voltage at the non-inverting input is again equivalent to the inverting input of amplifier A1 and further ramp down results in immediate switching of the output low providing dropout of the switching circuit and relay.

The inrush gate generator comprises amplifier A2 and its peripheral circuitry and is used to generate a gate interval of sufficient duration to allow for contactor pickup. The interval of time provided is sufficient to allow pickup under simultaneous adverse operating conditions of low source voltage and high coil temperature. Such conditions are exemplary of reactivation of the contactor immediately subsequent to shutting off the contactor after a long interval of operation at rated through put current in a maximum ambient temperature environment. The present embodiment provides a gate period of 5 coil time constants for the inrush interval.

Limitation of inrush current, which will be discussed in detail subsequently, is provided by the invention in the embodiment shown. Excessive current inrush occurs when voltage from the source is high and temperature of the coil is low providing a maximum stress condition for the entire coil power system. In prior art devices over design of power switches, wiring, fuses, etc., was required to accommodate this condition.

Resistors R20 and R8 establish a reference voltage at the non-inverting input of amplifier A2 of about 2.3 volts DC in the embodiment shown. The output of amplifier A1 is initially low, therefore capacitor C2 is at a ground potential and the output of amplifier A2 is high. When the output of threshold amplifier A1 goes high, capacitor C2 begins to charge through resistors R6 and R7. Values of those resistors are chosen to charge capacitor C2 to the reference potential on the non-inverting input of amplifier A2 in approximately 5 coil time constants after which the potential on the inverting input exceeds the reference level and the output of amplifier A2 is driven low, ending the gated inrush interval. The governing equation for the inrush gate is shown in the following equation:

$$T_{inrush\ gate}=-(R6+R7)\ C2[\ln(V_{ref(non\text{-}invert)}/V_{out\ A1})]$$

Resistor R7 is sized much larger than resistor R6, in the embodiment shown, such that diode D2 provides a quick discharge path for capacitor C2 when power is removed from the circuit. Capacitor C2 is therefore fully discharged substantially immediately after coil power is removed, thereby requiring capacitor C2 to fully recharge upon immediate reapplication of power ensuring a full inrush interval should an immediate restart sequence occur after shutdown. Resistor R8 provides the necessary hysteresis for stable switching.

The current control loop comprises a variable duty cycle oscillator and current sampling feedback network for duty cycle control for inrush current limitation and during low power holding mode. Transition of the output of inrush gate generator amplifier A2 to a high level is provided to the non-inverting input of amplifier A3 through resistor R19 and diode D3. A high shifted level at the non-inverting input of amplifier A3 provides a high output, closing transistor Q1, which acts as switch $S_1$, of FIG. 1, to provide current to the coil. The high level on the non-inverting input of amplifier A3, during the gating period with high output from amplifier A2, maintains switch Q1 closed through the pickup interval, except for excessive inrush current limiting, as will be described in greater detail subsequently. Upon completion of the gating interval, the output of amplifier A2 goes low ending the inrush interval and the oscillator circuit in the current control loop transitions to the low power holding mode.

Current regulation in the low power holding mode is accomplished by sampling the coil current across resistor $R_s$. Timing of oscillator operation is shown in FIG. 5. The refresh interval, during which output of oscillator amplifier A3 is high closing switch Q1, is defined by times $t_o$ and $t_1$. During this interval switch Q1 is closed and current flows from the external voltage source through the coil and sense resistor $R_s$. Coil current increases in accordance with the limitations of the coil current time constant and amplitude of the source voltage $V_s$. Once coil current rises to the predetermined holding value, as determinded by the voltage reference at the non-inverting input of amplifier A3, the control loop opens switch Q1.

Amplifier A4 actively rectifies and amplifies the sensed coil current based on voltage drop across resistor $R_s$ as current signal $V_{R_s}$ at the non-inverting input. The feedback structure on amplifier A4 provides signal shaping. Referring to FIG. 5, at $t_o$ switch Q1 closes and the external voltage source current rises immediately to the low limit of the holding current ripple. Amplifier A4 amplifies the signal by the ratio (R14+R15)/R15 which appears at the output as voltage $V_{OUT,A4}$, as shown in FIG. 3, which charges capacitor C3 through resistor R13 providing a time delayed signal to the inverting input of amplifier A3 ($V_{INV,\ A3}$). The time constant restricts the change in voltage with time at the inverting input of amplifier A3 to less than the operational amplifier slew rate to assure regenerative switching of amplifier A3. However, the time constant created by resister R13 and capacitor C3 is much less than the minimum coil on time so that soon after the beginning of conduction through switch Q1 the voltage signal at the inverting input of amplifier A4 is a representative analog of the sensed coil current signal at resistor $R_s$.

The non-inverting input of amplifier A3 is high based on the output of amplifier A3 feeding back through resistor R11. As shown in FIG. 5 at times $t_1$+, the coil current analog at the inverting input of amplifier A3 begins to exceed the set point value ($V_{NONINV,A3,HI}$) at the non-inverting input pulling the output of amplifier A3 low, shutting off switch Q1 and terminating the refresh interval. Feedback through resistor R11 shifts the reference voltage at the non-inverting input of amplifier A3 down to the low level ($V_{NONINV,A3,LO}$) as shown in FIG. 5. The refresh interval from $t_0$ to $t_1$, is the time during which switch Q1 is on ($T_{on,Q1}$).

Between refresh intervals switch Q1 is off for a substantially fixed time interval $T_{off,Q1}$ as shown in FIG. 5. Capacitor C3 connected to the inverting input of amplifier A3 begins to discharge through resistors R13, R14 and R15 while diode D4 is blocking the fast discharge path that would otherwise be available sinking through the output of amplifier A4. The voltage signal at the inverting input of amplifier A3 therefore decays exponentially. The time required for the voltage on capacitor C3 to decay to the low level of the referenced voltage at the non-inverting input of amplifier A3 defines $T_{off,Q1}$ of the cycle. The full duty cycle ends at time $t_2$.

The off time of the current control cycle is fixed and independent of variable circuit parameters such as source voltage, coil temperature, etc. and is solely determined by selection of the feedback and reference elements. The off time is determined according to the following equation:

$$T_{OFF} = -C_3(R13 + R14 + R15)\ln\left[\frac{V_{th} + (V_{OUT,A3,LO} - V_{th})\left(\frac{R_{th}}{R_{th} + R_{11}}\right)}{V_{th} + (V_{OUT,A3,HI} - V_{th})\left(\frac{R_{th}}{R_{th} + R_{11}}\right)}\right]$$

$$\text{Where: } V_{th} = V_{cc}\left(\frac{R_{10}}{R_{10} + R_9}\right)$$

$$V_{cc} = 5.0\text{V}$$

$$R_{th} = \frac{R9(R10)}{R9 + R10}$$

$$\left.\begin{array}{l} V_{OUT,A3,HI} = 3.8\ V \\ V_{OUT,A3,LO} \approx OV \end{array}\right\}\text{for } LM\ 2902\ OP\ \text{AMP}$$

Subsequent to time $t_2$, a new cycle begins providing coil refresh with switch Q1 on and conducting coil current being sourced from the external voltage source.

Figure 6A:
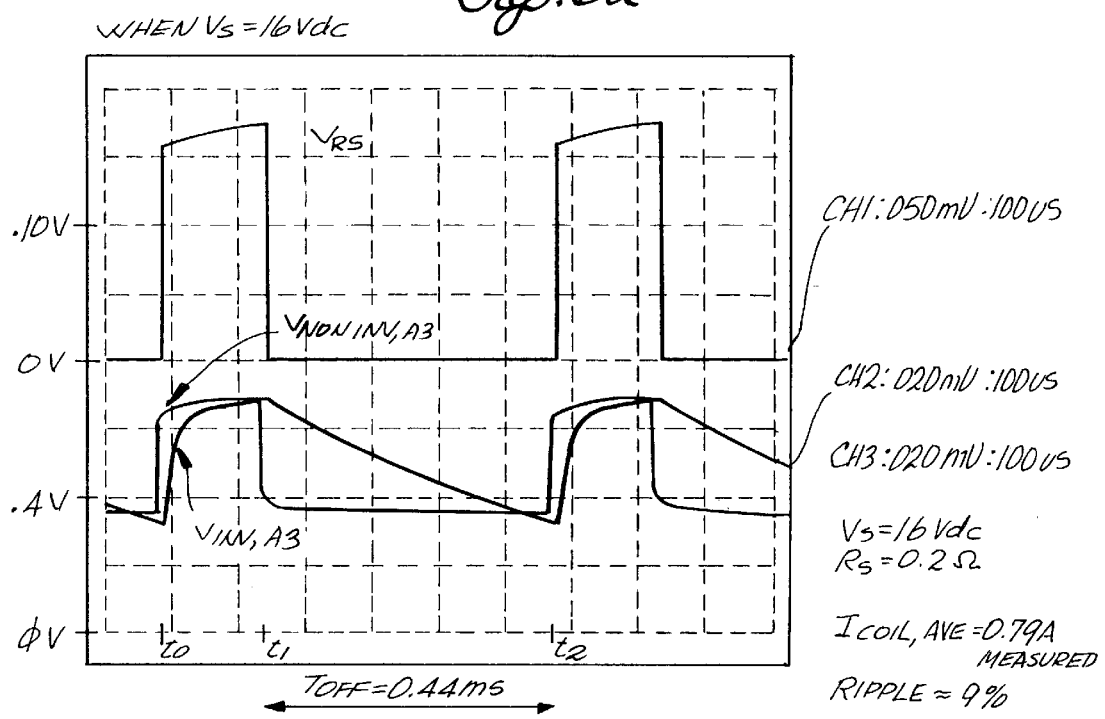
FIGS. 6*a* and 6*b* graphically depict the duty cycle for the embodiment of the invention shown in FIG. 3 at two representative source voltages.
Figure 6B:
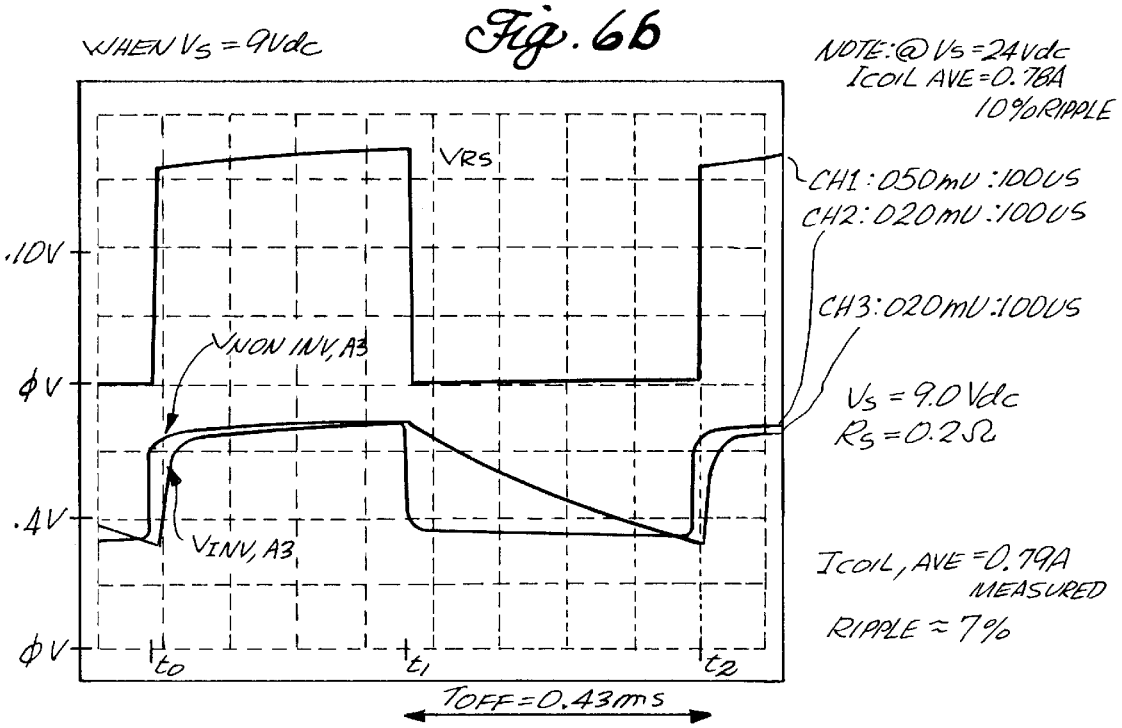
Figure 7A:
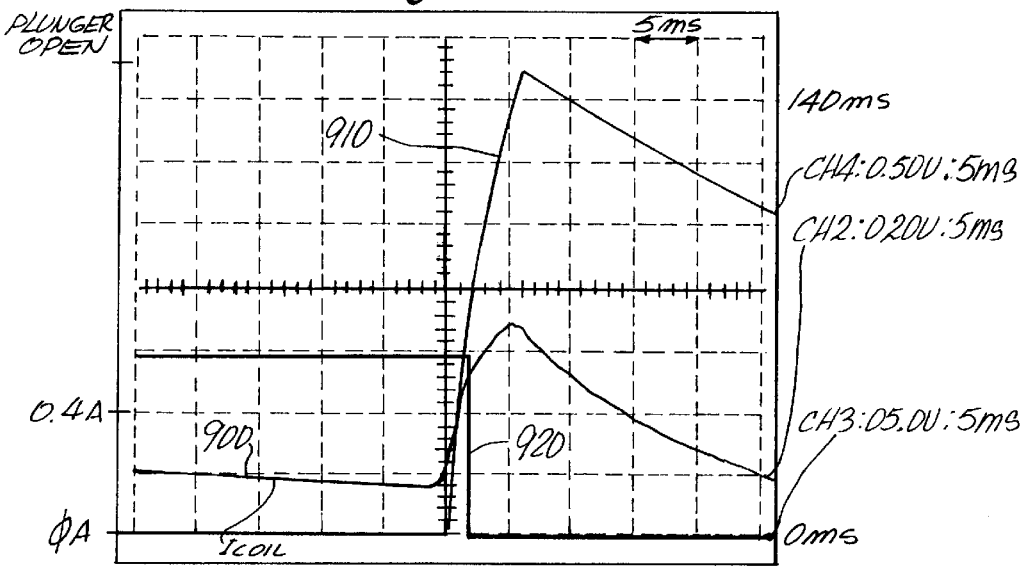
FIGS. 7*a* and 7*b* graphically represent armature position and the effects of regeneration based on residual current in the coil of an economizer system without the dropout circuit of the present invention.
Figure 7B:
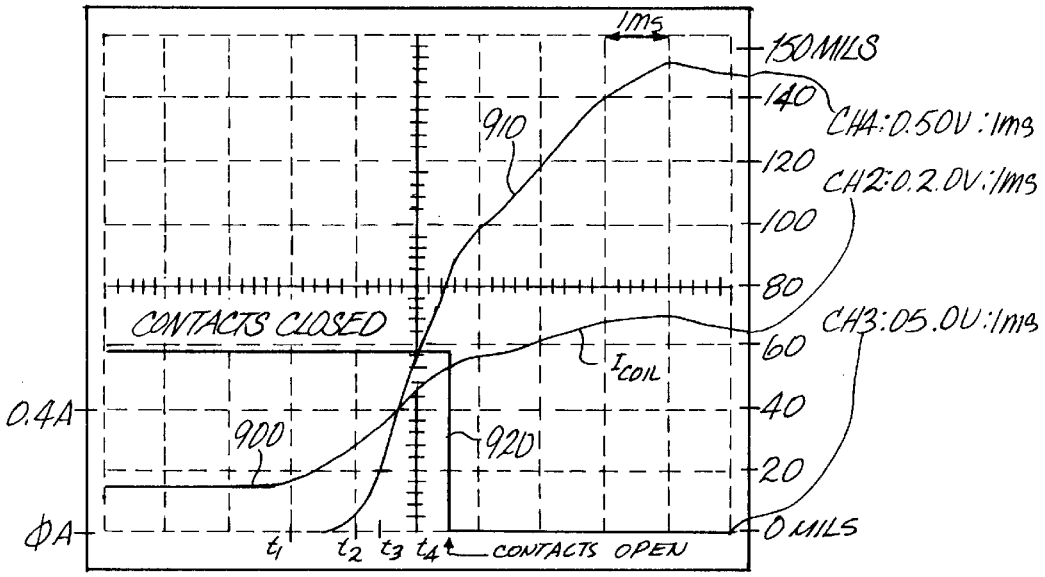

The duty cycle for the oscillator is determined based on sampling of the coil current by amplifier A4 which also compensates for changes in coil temperature. Variation in the duty cycle at two voltage levels is demonstrated in FIGS. 6*a* and 6*b* for 16 volts and 9 volts respectively. The source current off intervals are of constant duration, however, the refresh interval varies depending on the time required to refresh the coil to the set point determined by the variable effects of source voltage and coil temperature (which changes the coil resistance). A typical range for the 12 volt DC nominal system for which the present embodiment was designed is 24 volts to 6.5 volts DC.

While switch Q1 is off, coil current is sustained through the free wheeling diode D7. Switch Q1 is switched on and off softly through the gate ramp network of resistor R12 and capacitor C4. Soft switching provides the added benefit of reduced conducted and radiated emissions from the chopper system. For the embodiment shown switch Q1 is a logic level switching MOSFET suitable for drive by operational amplifier A3 operating from a 5 VDC source. For a typical embodiment Q1 is on with greater than 3.0 volts DC applied to the gate and off with less than 1.0 volts DC applied to the gate.

The inrush gate generator and current control of the present invention cooperatively provide limitation of inrush current when operating conditions would otherwise allow an enormous inrush current. Such a condition occurs when the voltage from the source is high and temperature of the coil is low as with a cold startup. Current limitation is accomplished in the embodiment shown using the network comprising resistors R9, R10, R11, R19 and diode D3. R19 is selected to adjust the reference voltage upward on amplifier A3 during the inrush interval to cause the oscillator to engage for current limit chopping if the inrush current exceeds the upwardly adjusted threshold. Feedback proportional to the inrush current is provided by means of amplifier A4 sampling current across resistor $R_s$ as described previously. When amplifier A2 goes low ending the inrush interval diode D3 blocks amplifier A2 from any further effect on the oscillator and the current control loop shifts to the low power holding mode previously described.

A voltage regulator IC2 is provided to regulate power for operational amplifiers A1, A2, A3 and A4 providing a reference voltage for coil current regulation activity and to protect the control circuitry of amplifiers A1, A2, A3 and A4 from transient voltages inherent in the power distribution system voltage source. In the embodiment shown voltage regulator IC2 is a low power voltage regulator such as a Micrel MIC 5200 which operates at 5.0 VDC+/−=1% regulation with 100 mA maximum output. Negative going transient pulses are blocked by polarity protecting diode D9 while positive going transients are suppressed by the network of resistor R21 and capacitor C6 in addition to transient rejection capability of the regulator IC2. Capacitor C7 is selected to provide stability for the output of the regulator based on manufacturer's recommendations.

The final element of the present invention is the fast dropout circuit. The drop-out feature of the present invention is provided by transistor $Q_2$, which acts as switch $S_2$ of FIG. 1. When source voltage is applied to the circuit, switch $Q_2$ is fully on, allowing operation of the circuit in a powered mode through switch $Q_1$ and in a current return mode through free-wheeling diode $D_7$. Voltage from the source through resistor $R_{17}$ fast charges capacitor C5 above the gate threshold voltage to turn on switch $Q_2$. Capacitor C5 provides capacity for sustaining $Q_2$ on when $Q_1$ is in the off interval of the oscillator cycle. The desired fast drop-out, to rapidly drain current from the coil when the actuator is turned off, is accomplished by the drop-out switch $Q_2$. Removal of source power causes $Q_2$ to open after capacitor C5 discharges throuigh resistor R16 below the gate threshold voltage, breaking the low impedance current-return circuit. In the embodiment shown in the drawings, reverse-biased zener diode $D_6$ is then in the coil discharge loop in series with free-wheeling diode $D_7$. The dynamic resistance of diode $D_6$ immediately and substantially raises the discharge time constant of the coil through $D_6$. This results in rapid coil-current decay. The operation of the present circuit without and with the fast drop-out switch is shown in FIGS. 7*a* and 7*b* and 8*a* and 8*b*, respectively. Without the rapid drop-out capability, the current in the coil decays slowly through free-wheeling diode $D_7$, as shown by curve 900. The armature position is shown in curve 910, with the contact state shown in curve 920. As the armature begins to move, the remaining current in the coil causes regeneration in the coil due to the continued magnetization of the armature. This in turn results in a reduction of velocity for the armature, as is clearly seen in FIG. 7*b* wherein the velocity of the armature is derived from the slope of position curve 910. This slowing of velocity, which occurs substantially simultaneously with opening of the contacts, impedes rapid displacement of the contacts from the closed position, thereby increasing the arcing burn time as the contacts open and increasing the probability that welded contacts will not be opened by the less energetic armature action.

Figure 8A:
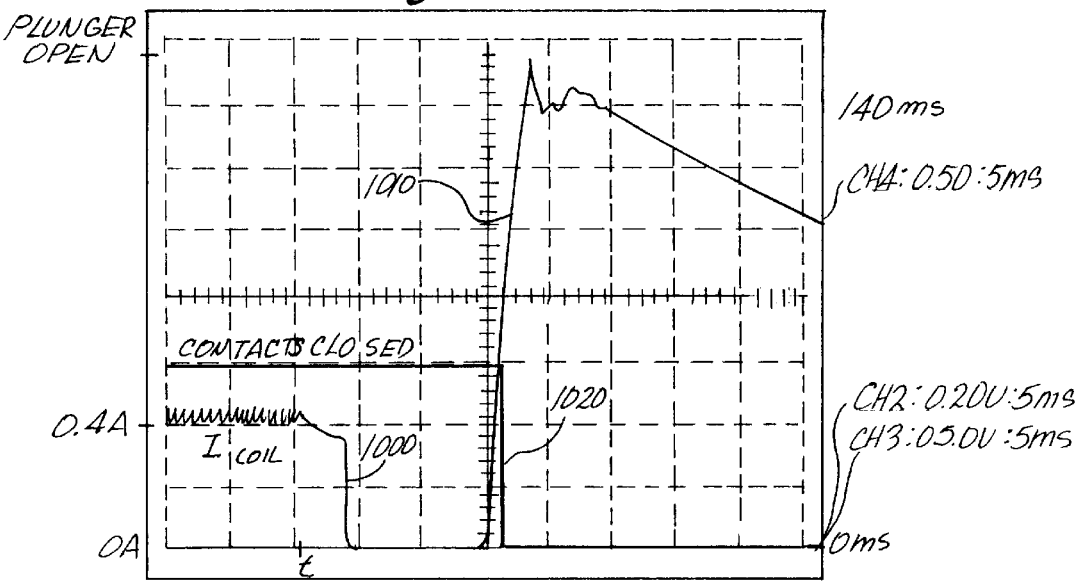
FIGS. 8*a* and 8*b* graphically represent the armature position during deactivation of the actuator with the dropout circuit of the present invention.
Figure 8B:
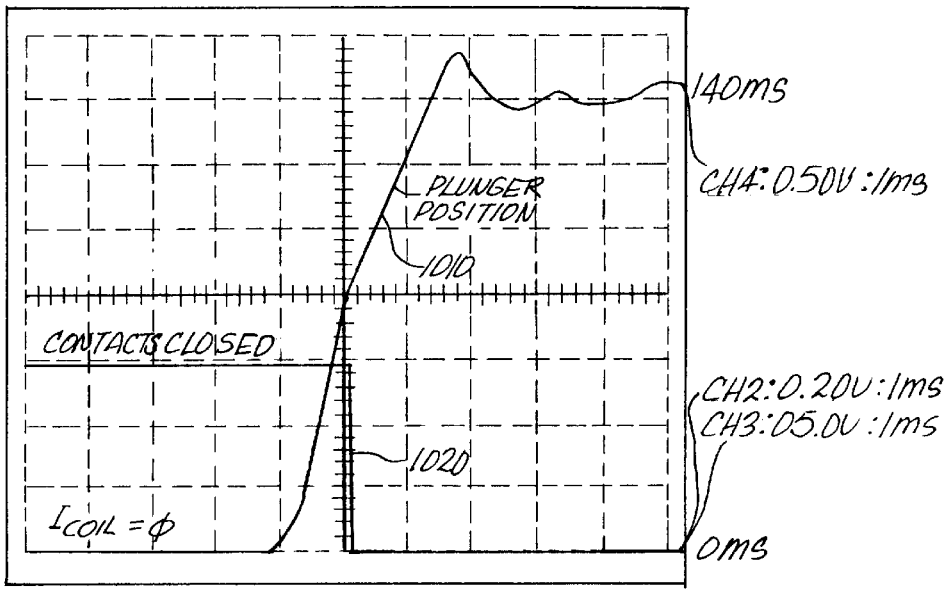

With the drop-out switch in place, removing source power results in an immediate decay of the coil current, as shown in FIG. 8*a*, with coil current represented by signal 1000 which immediately drops to zero. Armature position, shown by curve 1010, has significantly higher velocity since no regeneration occurs due to residual coil current. As shown in an expanded scale in FIG. 8*b*, the armature attains a full open position significantly sooner than shown in FIG. 7*b*.

Figure 4:
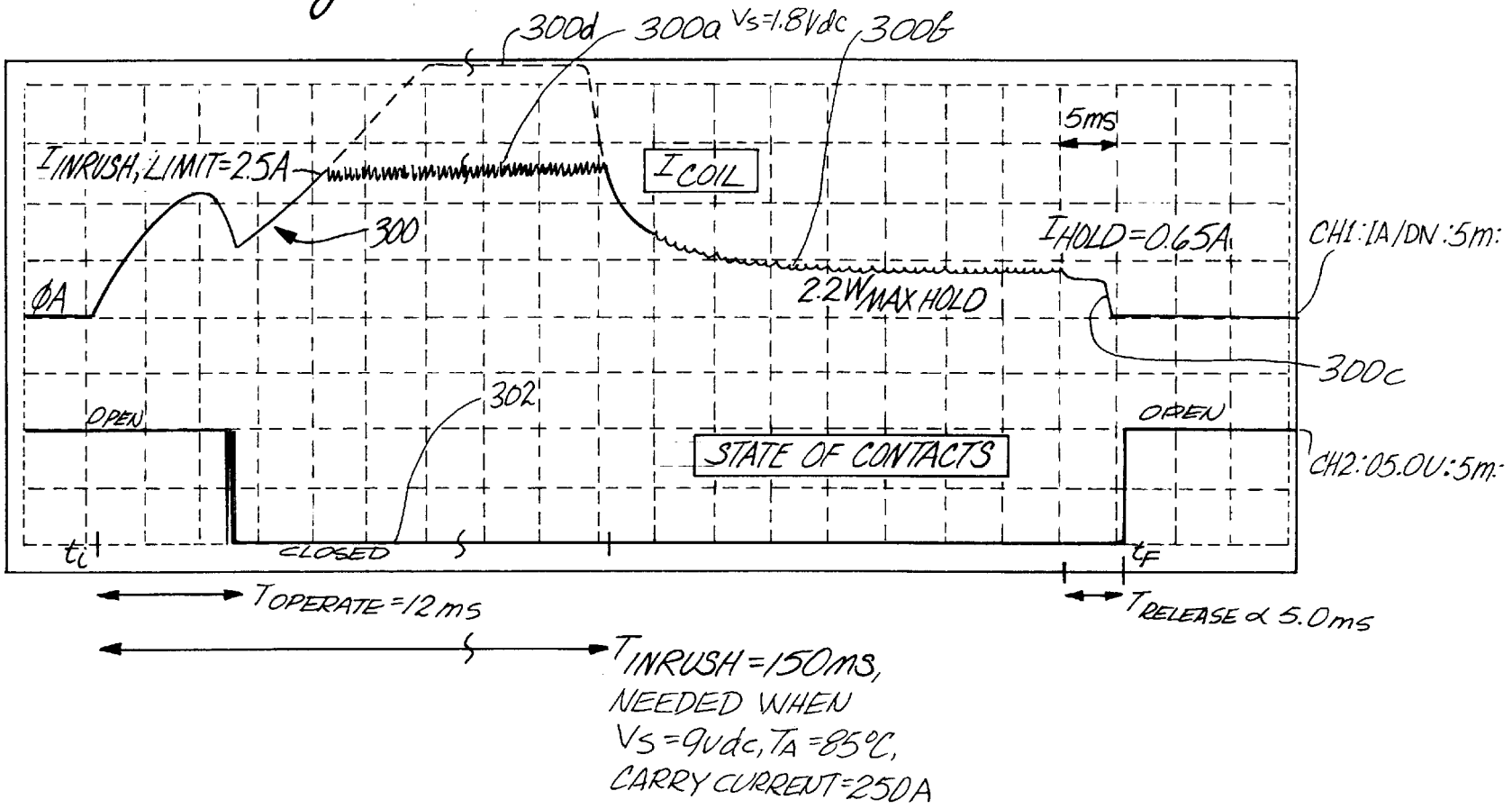
FIG. 4 graphically demonstrates the coil current cycle for the embodiment of the invention shown in FIG. 3 including inrush limitation and holding current with a representation of the state of the contacts of the actuator.

A complete operating cycle for the activating and deactivating of an exemplary actuator is shown in FIG. 4. The actuator comprises a Czonka 12 volt actuator. A source voltage $V_s$ of 18 volts DC is shown to demonstrate inrush current limitation. Upon activation of the activator at time $t_1$ by closing switch $S_0$ current increases as shown by curve 300 time for current buildup in the coil to achieve operation of the actuator is defined as $T_{operate}$ which approximately equals 12 milliseconds for the system shown. At that time sufficient MMF in the coil is available to actuate the armature and drive the contacts closed as shown by curve 302. In the embodiment described a current inrush limit of 2.5 amps has been established which results in actuation of the oscillator at the elevated inrush current threshold shown by that portion of the curve 300 labelled 300*a*. For the exemplary source voltage $V_s$ of 18 volts DC if inrush current limitation was not available a peak coil current of 6.6 amps would be reached during the current inrush period as shown in phantom for the portion of the curve 300 designated 300*d*.

Upon completion of the inrush gate interval shown in FIG. 4 as $T_{inrush}$ which is approximately 150 milliseconds for the embodiment disclosed, the output of amplifier A2 goes low placing the current control loop in low power holding mode, causing the current to decay as shown by the portion of curve 300 designated 300*b*. Average current at the holding level for the embodiment disclosed is 0.65 amps providing a 2.2 watt power level. Upon opening switch SW1 to deactivate the relay, rapid decay in the coil current as shown by the portion of the curve 300 designated 300*c* employing the fast dropout circuit previously described, causes release of the contacts within approximately 5 milliseconds.

The present invention as defined in the embodiments disclosed provides significant benefit over the prior art in allowing the use of only N-CHANNEL MOSFETs for the coil drive circuit. Current sensing only during the conduction mode of the switched transistor operation allows both the sense resistor and the switching transistor to be located and controlled on the low side of the load. This approach is particularly attractive for relay direct current coil economizing applications since the coil load maintains relatively stable impedence anywhere within its operating envelope. The fixed off time feature of the invention, as disclosed, can be preset to keep the ripple current in the coil at a desired design level. Since the current control maintains the switch transistor off for a fixed amount of time, there is no need to sense the coil current during the off time since the off time is preset during design to account for the worst case low impedance of the coil/acturator and account for the worst case ripple. The ability to control from the low side of the load additionally avoids complexity problems typical of P-type semiconductors required for high side control which for high voltage inductive load systems require isolation between the high side switch transistor and the low side sense resistor and control electronics. Expensive DC to DC converters and/or optical isolators used for transmission of dry power and dry logic to the switching transistor are avoided.

Figure 9A:
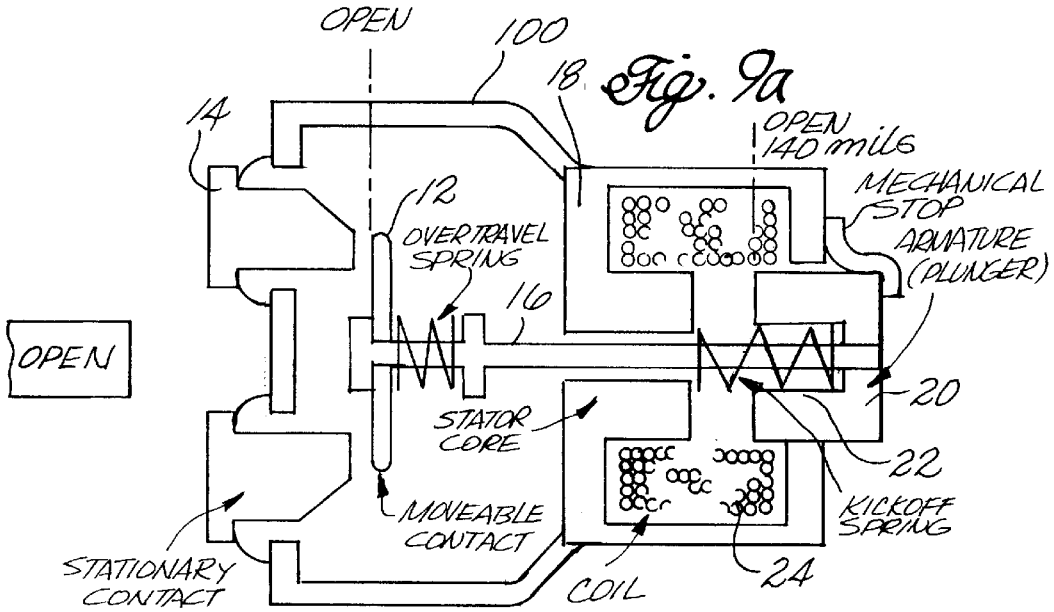
FIGS. 9*a*, 9*b* and 9*c* are schematic cross sections of a Czonka activator with which the controller of the present invention is employed showing the open, make/break and closed positions.
Figure 9B:
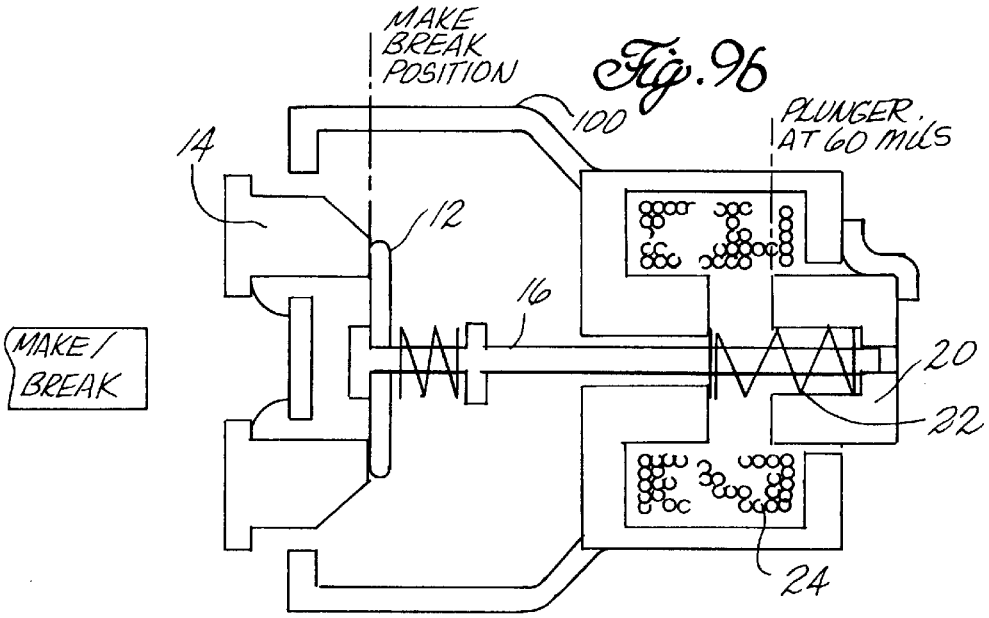
Figure 9C:
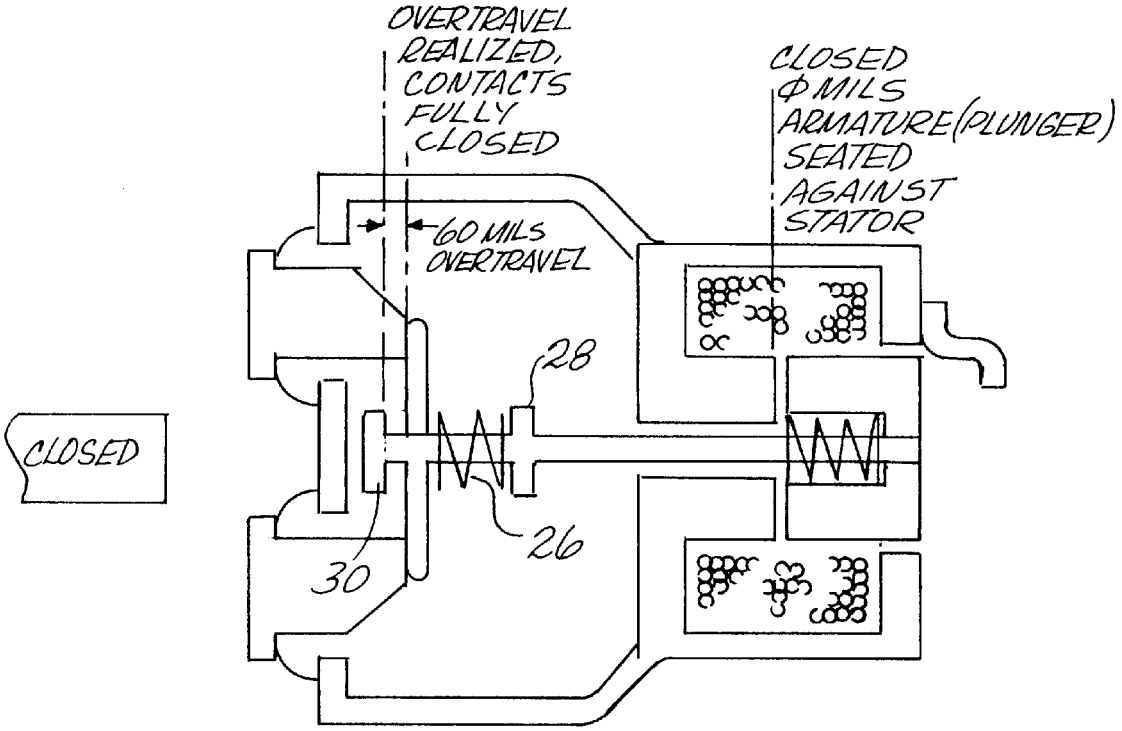

Significant advantages for coil size and operation efficiency for an actuator can be achieved with the embodiment of the invention disclosed. An exemplary Czonka actuator, as shown in FIG. 9*a*, 9*b* and 9*c*, enjoys significant size reduction and operational capability increase through the use of the present invention. As shown in FIG. 9*a*, in the open condition, the actuator 10 has movable contact 12 displaced from stationary contacts 14 by approximately 60 mils. The movable contact is carried by armature shaft 16 which extends through the stator core 18 and terminates in armature plunger 20. A kickoff spring 22 is engaged between the armature plunger and the stator maintaining the unactuated armature in the open position with a clearance from the stator of approximately 140 mils.

For actuation, coil 24 receives current from the current control loop, as previously described, providing MMF to urge the plunger toward the stator. At the make/break position shown in FIG. 9*b*, the armature plunger has traveled approximately 60 mils bringing the movable contact into engagement with the stationary contacts in the actuator. Continued motion of the plunger through the remaining 60 mils to contact the state, as shown in 9*c*, places the actuator in the closed position with the armature shaft compressing over-travel spring 26 between a boss 28 and movable contact 12. The armature shaft terminates in an end portion 30 which engages the movable contact upon deactivation of the actuator and armature motion to the open position. Table I demonstrates the capability of the Czonka actuator with the present invention, and without the present invention. Inrush current limitation capability provided by the present invention, in addition to significantly reduced holding current, allows reduction in coil size from 1230 turns to 780 turns with a commensurate reduction in resistence from 9.7 ohms to 3.85 ohms. This is accomplished while maintaining contact force at 4 pounds. Work potential with the present invention is increased from 107 millijewels to 163 millijewels providing an increase in snap energy for breaking welding contacts from 32 millijewels to 73 millijewels. Armature hold open force is increased from 1.2 pounds to 3.5 pounds while significantly reducing the net coil power required in the holding condition from 10.7 watts to only 2.3 watts. The resultant coil temperature rise in operation is therefore only 9° C. as opposed to 43° C. in an actuator without the present invention.

TABLE I

Performance of Czonka With and Without Invention

| PARAMETER | UNIT | WITH INVENTION | WITHOUT INVENTION |
|---|---|---|---|
| Coil Power | | | |
| inrush @ −55° C., 28V | W | 19 | 22 |
| holding @ 25° C., 28V | W | 2.3 | 10.7 |
| Work Potential | MJ | @ 1400 AT | @ 700 AT |
| (area under force vs. trav. curve) | | 163 | 107 |
| Springs' Snap Energy (area under springs from closed to break position) | MJ | 73 | 32 |
| Contact Force | LB | 4.0 | 4.0 |
| Armature Hold OPEN Force | LB | 3.5 | 1.2 |
| Contact Wear allowance (leave 20 mils reserve) | mils | 40 | 20 |
| Minimum Pickup Voltage (@ 85° C., rated carry current) | Vdc | 23 | 23 |

TABLE I-continued

Performance of Czonka With and Without Invention

| PARAMETER | UNIT | WITH INVENTION | WITHOUT INVENTION |
|---|---|---|---|
| Coil Temp. Rise (above 85° C., rated carry current) | °C. | 9 | 43 |
| Coil Data | | | |
| turns | N | 780 | 1230 |
| resistance 25° C. | Ω | 3.85 | 9.7 |

Having now described the invention in detail as required by the patent statutes, those skilled in the art will recognize modifications and substitutions to the specific embodiments disclosed to accommodate particular applications. Such substitutions and modifications are within the scope and intent of the present invention as defined in the following claims.

What is claimed is:

1. A control circuit for coil current in a spring biased DC actuator having a coil circuit receiving power from a voltage source, the control circuit comprising:

a switch in the coil circuit and controllable by a switch control signal to close the coil circuit;

a power switching circuit connected to the switch to provide the switch control signal, the power switching circuit having a threshold detector providing a triggering signal for initiating operation of the control circuit responsive to a predetermined source voltage, a gate signal generator comprising an RC circuit and an operational amplifier responsive to the triggering signal and having a time constant sufficient to drive the coil through a pickup interval, and means for generating the switch control signal responsive to the gate signal and having a duty cycle responsive to the voltage of the voltage source; and a rapid dropout circuit comprising a diode and transistor for reducing current in the coil prior to substantial movement of the actuator.

2. A DC actuator system for a high current contactor comprising:

a spring-biased DC actuator including a coil circuit for opening and closing contacts, the coil circuit having a switch controllable by a switch control signal;

a voltage source; and control circuit means for controlling current to the coil circuit for providing sufficient armature force for contact closure and rapid dropout of the contactor to break welded contacts and for allowing pickup.

3. A control circuit as defined in claim 2 wherein the generating means comprises:

a current controlled oscillator.

4. A control circuit for coil current in a spring biased DC actuator having a coil circuit receiving power from a voltage source, the control circuit comprising:

an oscillator chopper circuit for periodically interrupting power to the coil, said oscillator controlled by a feedback amplifier sampling coil current;

a sustaining current return circuit providing a current return for the coil when power is interrupted by the chopper; and a dropout switch in series with the coil and ground for opening the current return circuit responsive to removing power to the coil circuit.

5. A control circuit as defined in claim 4 wherein the dropout switch comprises an NMOS transistor switched by the voltage source.

6. A control circuit as defined in claim 5 further comprising a zener diode in parallel with the dropout switch for power dissipation.

7. A control circuit for coil current in a spring biased DC actuator having a coil circuit receiving power from a voltage source, the control circuit comprising:

a switch in the coil circuit and controllable by a switch control signal to close the coil circuit;

a power switching circuit connected to the switch to provide the switch control signal, the power switching circuit having a threshold detector providing a triggering signal for initiating operation of the control circuit responsive to a predetermined source voltage, a gate signal generator responsive to the triggering signal and having a time constant sufficient to drive the coil through a pickup interval, means for generating the switch control signal responsive to the gate signal and having a duty cycle determined by an oscillator controlled by a feedback amplifier sampling coil current for a first inrush level limit current and a second holding current responsive to the voltage of the voltage source;

a sustaining current return circuit providing a current return for the coil when power is interrupted by the chopper; and a dropout switch in series with the coil and ground for opening the current return circuit responsive to removing power to the coil circuit.

8. A control circuit as defined in claim 7 wherein the dropout switch comprises an NMOS transistor switched by the voltage source.

9. A control circuit as defined in claim 8 further comprising a zener diode in parallel with the dropout switch for power dissipation.

10. A control circuit as defined in claim 7 wherein the oscillator of the generating means has a substantially fixed off time.

* * * * *

UNITED STATES PATENT AND TRADEMARK OFFICE

CERTIFICATE OF CORRECTION

PATENT NO. : 5,914,849
DATED : June 22, 1999
INVENTOR(S) : G. Stephen Perreira

It is certified that error appears in the above-identified patent and that said Letters Patent is hereby corrected as shown below:

Column 2, line 29, replace "changeing" with -- changing --.
Column 5, line 35, replace "at rated through put" with
-- rated at throughput --.
Column 8, line 46, replace "throuigh" with -- through --.
Column 9, line 51, replace "impedence" with -- impedance --.
Column 9, line 58, replace "coil/acturator" with -- coil/actuator --.
Column 10, line 4, replace "FIG. 9a, 9b and 9c" with
-- FIGS. 9a, 9b and 9c --.
Column 11, lines 52-53, delete claim 3 in its entirety and insert therefor
-- A DC actuator system as defined in claim 2 wherein the control circuit means comprises:
a current controlled oscillator for generating the switch control signal. --.

Signed and Sealed this

Tenth Day of April, 2001

*Attest:*

Nicholas P. Godici

NICHOLAS P. GODICI

*Attesting Officer*

*Acting Director of the United States Patent and Trademark Office*